US005800136A

United States Patent [19]

Kurth et al.

[11] Patent Number: 5,800,136

[45] Date of Patent: Sep. 1, 1998

[54] PUMP WITH BYPASS VALVE

[75] Inventors: Brian J. Kurth, Lake Elsinore; Anil B. Patel, La Crescenta, both of Calif.

[73] Assignee: Shurflo Pump Manufacturing Co., Santa Ana, Calif.

[21] Appl. No.: 807,788

[22] Filed: Feb. 28, 1997

[51] Int. Cl.[6] ..... F04B 49/00

[52] U.S. Cl. ..... 417/311; 417/307; 417/269

[58] Field of Search ..... 417/311, 307, 417/269; 137/115.13, 115.28, 538

[56] References Cited

U.S. PATENT DOCUMENTS

| | | | |
|---|---|---|---|
| 2,942,550 | 6/1960 | Carter . | |
| 2,971,470 | 2/1961 | Wein et al. . | |
| 3,314,600 | 4/1967 | Hadley . | |
| 3,684,406 | 8/1972 | Edwards . | |
| 4,153,391 | 5/1979 | Hartley | 417/269 |
| 4,305,702 | 12/1981 | Hartley . | |
| 4,396,357 | 8/1983 | Hartley . | |
| 4,507,058 | 3/1985 | Schoenmeyr . | |
| 4,545,735 | 10/1985 | Ims . | |
| 4,610,605 | 9/1986 | Hartley | 417/269 |
| 4,646,781 | 3/1987 | McIntyre et al. . | |
| 5,203,803 | 4/1993 | Schoenmeyr | 417/269 |
| 5,261,792 | 11/1993 | Schoenmeyr | 417/269 |
| 5,462,413 | 10/1995 | Schroeder | 417/311 |
| 5,571,000 | 11/1996 | Zimmermann et al. . | |

FOREIGN PATENT DOCUMENTS

| | | |
|---|---|---|
| 0093674 | 11/1983 | European Pat. Off. . |
| 509224 | 10/1930 | Germany . |
| 1907454 | 2/1969 | Germany . |
| 404255593 | 9/1992 | Japan . |
| 654636 | 6/1951 | United Kingdom . |

*Primary Examiner*—Charles G. Freay
*Assistant Examiner*—Cheryl J. Tyler
*Attorney, Agent, or Firm*—Frank J. Uxa

[57] ABSTRACT

A pump includes a housing having at least a first pumping chamber, an inlet, an inlet passage leading from the inlet to the pumping chamber, an outlet and an outlet passage leading from the pumping chamber to the outlet. A first pumping member is movable in the pumping chamber on an intake stroke whereby fluid from the inlet passage is drawn into the pumping chamber and on a discharge stroke whereby fluid in the pumping chamber is discharged into the outlet passage. A drive is provided for moving the pumping member on the intake and discharge strokes. A bypass passage leads from a location in the outlet passage to a location in the inlet passage. A bypass valve is provided and is movable in response to the pressure from the outlet passage and substantially independent of the pressure from the inlet passage between an open position in which fluid flows through the bypass passage and a closed position in which fluid is prevented from flowing through the bypass passage. Having a bypass valve movable only in response to the pressure from the outlet passage enhances the reliability and consistency of bypass valve operation.

19 Claims, 2 Drawing Sheets

PUMP WITH BYPASS VALVE

BACKGROUND OF THE INVENTION

The present invention relates to pumps with bypass valves. More particularly, the invention relates to positive displacement pumps with bypass valves useful for pumping fluids, preferably liquids, such as water.

A great number of pumps have been known for use in pumping various liquids. One such class of pumps are diaphragm pumps, for example, driven by wobble plates. Pumps of this general nature are shown, by way of example, in Hartley U.S. Pat. No. 4,153,391 and Hartley U.S. Pat. No. 4,610,605.

Such pumps often include a pressure switch which starts and stops the pump motor based on the outlet fluid pressure of the pump. In order to avoid continuous on and off cycling of the pump motor, various bypass valves have been proposed. Using a bypass valve, the pump motor remains on and the pumped liquid is bypassed from the outlet side to the inlet side of the pump. Examples of pumps which include bypass valves include those disclosed is Shoenmeyr U.S. Pat. No. 5,261,792 and Zimmermann et al U.S. Pat. No. 5,571,000.

There continues to be a need for new pumps with bypass valves which are straightforward in construction and operation, and provide effective, reliable and consistent fluid bypassing.

SUMMARY OF THE INVENTION

Pumps including straightforward bypass valves which respond to outlet fluid pressure substantially independent of inlet fluid pressure have been discovered. The present pumps have bypass valves which move at very well defined and controlled outlet fluid pressures from a closed position to an open position to allow effective bypass of the pumped fluid. In addition, outlet fluid pressure at which the bypass valves moves from closed to open preferably can be adjusted to provide flexibility, as needed and desired. The present bypass valves are easy to manufacture and maintain, and are very effective and reliable in use.

In one broad aspect of the present invention, pumps comprising a housing, at least a first pumping member, a drive, a bypass passage and a bypass valve are provided. The housing has at least a first pumping chamber, an inlet, an inlet passage leading from the inlet to the pumping chamber, an outlet and an outlet passage leading from the pumping chamber to the outlet. The first pumping member is movable within the first pumping chamber on an intake stroke such that fluid from the inlet passage is drawn into the pumping chamber. The first pumping member is also movable on a discharge stroke such that fluid in the pumping chamber is discharged into the outlet passage. The drive provides for moving the pumping member on the intake and discharge strokes.

The bypass passage leads from a location in the outlet passage to a location in the inlet passage. The bypass valve, and in particular the bypass valve element, is movable in response to the fluid pressure from the outlet passage and substantially independent of the fluid pressure from the inlet passage from a closed position in which fluid is prevented from flowing through the bypass passage to an open position in which fluid flows through the bypass passage. Preferably, this bypass valve is the only bypass valve included in the pump.

In one very useful embodiment, the bypass valve includes a surface exposed to the fluid pressure from the outlet passage with the bypass valve in the closed position, and a first seal, for example, an O-ring seal, positioned to prevent the surface from being exposed to the fluid pressure from the inlet passage with the bypass valve in the closed position. Preferably, the bypass valve further includes a second seal, for example, an O-ring seal, spaced apart from the first seal and positioned to prevent the portion of the bypass valve extending away from the surface beyond the second seal from being exposed to the fluid pressure from the inlet passage with the bypass valve in the closed position. The bypass valve preferably further includes an annulus, for example, circumscribing that bypass valve element, located between the first and second seals which is exposed to the fluid pressure from the inlet passage with the bypass valve in the closed position. This annulus is advantageous, for example, in that the fluid pressure from the inlet passage is not focused only at one point on the bypass valve element which can produce a side loading that can result in fluid leakage and/or the movement of the bypass valve based in part on the fluid pressure from the inlet passage. Such an annulus results in reducing, or even completely negating, the effect of the fluid pressure from the inlet passage on the bypass valve with the bypass valve in the closed position.

The bypass valve preferably is structured so that the fluid pressure from the outlet passage at which the bypass valve is movable from the closed position to the open position is adjustable.

The bypass valve preferably includes a valve element which is movable to place the bypass valve in the open position and in the closed position, and a bias member, for example, a spring, adapted to act on the valve element and being effective to urge the bypass valve into the closed position. In a particularly useful embodiment, the force on the bias member acting on the bypass valve element is adjustable. An adjusting member preferably is provided, and more preferably is adaptable to be threaded into the housing of the pump. This adjusting member is adapted to contact the bias member. The force of the bias member acting on the valve element is adjustable, for example, in response to the size, e.g., length, of the portion of the adjusting member threaded into the housing. This is a very convenient and reliable way of controlling the fluid pressure at which the bypass valve moves from the closed position to the open position.

In one embodiment, the valve element includes an internal bore and the bias member is located at least partly in this internal bore.

A very useful configuration provides a bypass valve which includes a bore in which the bypass valve element is at least partly located when the bypass valve is in the closed position. A stop member, for example, an appropriately sized rod, preferably is provided and is located between the valve element and the housing. The stop member is sized and adapted to prevent the valve element from moving completely out of the bore when the bypass valve is in the open position. This feature effectively prevents the valve element from being moved completely out of the bore, for example, by a surge in the outlet fluid pressure.

The size and configuration of the bypass passage is of some importance. For example, the bypass passage should be of sufficient size to effectively accommodate the fluid which is to be bypassed from the outlet side to the inlet side of the pump. In one embodiment, the bypass passage has a substantially uniform cross-section. The bypass passage can have a circular cross-section and/or a non-circular cross-section. The size and/or configuration of the bypass valve preferably is chosen to control the movement of the bypass valve so that the bypass valve moves effectively between the closed position and the open position rather than being movable so rapidly so as to result in undue wear and tear on the bypass valve and/or the other components of the pump.

In one embodiment, the bypass passage includes a plurality of spaced apart passageways from a location in the outlet passage to a location in the inlet passage. These passageways preferably are located at different points relative to the longitudinal axis of the bypass valve. Each of these passageways preferably has a different sized cross-section. In a very useful embodiment, the passageways are oriented so that the passageway with the smallest cross-section is located nearest the outlet passage when the bypass valve is in the closed position and the passageway with the largest cross-section is located furthest from the outlet passage when the bypass valve is in the closed position. In this embodiment, the degree or extent to which the bypass valve element is moved controls the amount of fluid that is bypassed. Put another way, this configuration provides for a substantial increase in fluid flow in the bypass passage as the outlet pressure increases and the bypass valve element is moved over a greater distance.

Although the presently useful bypass valve may be employed with any fluid handling pump, for example, a positive displacement liquid handling pump, it is particularly useful in pumps which have a plurality of pumping chambers and employ a wobble plate to provide for pumping member movement.

The various features of this invention can be used singly or in any combination. Thus, all such features and combinations are included within the scope of the present invention. The invention, together with additional features and advantages thereof, may best be understood by reference to the following description taken in connection with the accompanying illustrative drawings.

DESCRIPTION OF THE PREFERRED EMBODIMENT

Figure 1:
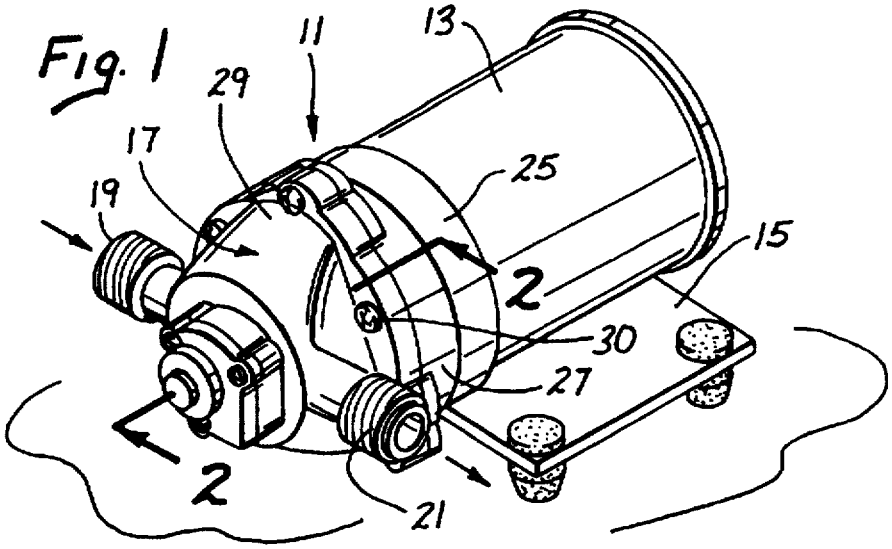
FIG. 1 is an isometric view of a pump constructed in accordance with the teachings of this invention.

FIG. 1 shows a pump 11 and an associated electric motor 13 mounted on a suitable base 15. As shown in FIG. 1, the pump 11 has a housing 17, an inlet 19, and an outlet 21. To a large extent, pump 11 is similar to the pumps disclosed in Hartley U.S. Pat. No. 4,610,605, the disclosure of which is hereby incorporated in its entirety herein by reference. A bypass valve, shown generally at 23, is coupled to the housing 17.

Figure 2:
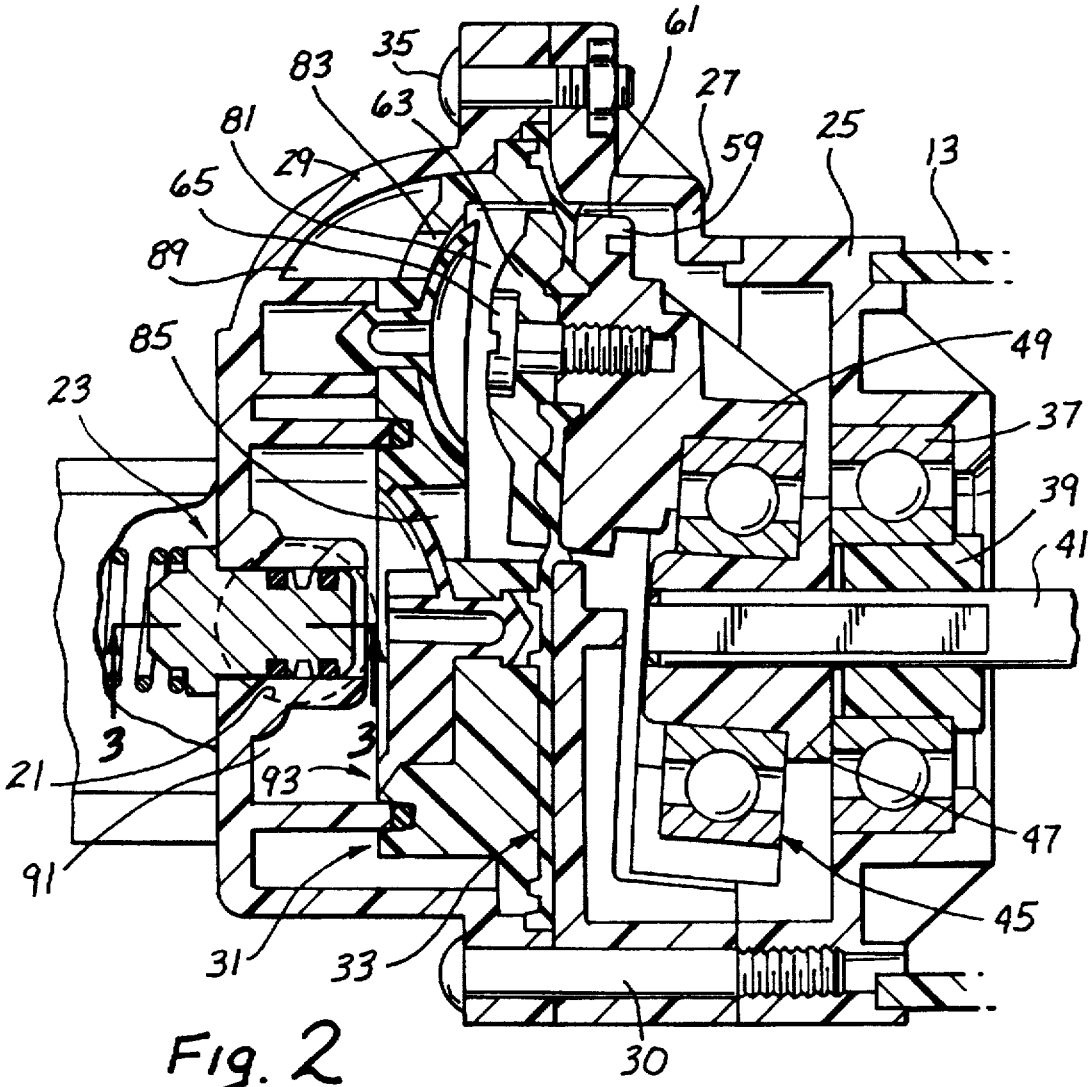
FIG. 2 is a fragmentary sectional view taken generally along line 2—2 of FIG. 1 showing one of the pumping chambers at the end of its intake stroke.

The housing 17, which may be of any suitable construction, in this embodiment includes a housing section 25 (FIG. 2) which may be coupled to the motor housing, an intermediate housing section 27 and a housing section 29. The housing section 25 can be joined to the housing section 27 and 29 by a plurality of fasteners 30. A valve plate 31 and a diaphragm 33 have their peripheral regions clamped between the housing sections 27 and 29, the latter being held together by fasteners 35 (FIG. 2). The diaphragm 33 extends completely across the interior of the housing 17 and partitions the housing interior. The housing sections 25, 27 and 29 and the valve plate 31 may be integrally molded from a suitable plastic material. The diaphragm 33 may be constructed of a suitable rubber.

The offset bearings 37 and 45, the bushings 39 and 47, motor shaft 41 and the wobble plate 49 form a wobble plate drive. With this construction, the wobble plate 49 is subjected to nutating motion.

The piston sections 59 (one shown in FIG. 2) are coupled, respectively, to three separate regions 61 (one shown in FIG. 2) and this is accomplished by clamping each such region between a diaphragm retainer 63 attached to the associated piston section 59 by a screw 65. The regions 61 preferably are identical and are joined to the associated piston sections 59 in the same manner as shown in FIG. 2.

As shown in FIG. 2, region 61 of the diaphragm 33 cooperates with the valve plate 31, the associated piston section 59, the retainer 63 and the associated screw 65 to define a pumping chamber 81. The other regions 61 of the diaphragm 33 cooperate similarly with corresponding structure to define two other identical pumping chambers. Each of the pumping chambers 81 has an inlet 83 (FIG. 2) extending through the valve plate 31 and an outlet 85 which also extends through the valve plate. The inlets 83 communicate with a common inlet chamber 89 which leads to the inlet 19. The outlets 85 lead to a common outlet chamber 91 which is in communication with the outlet 21.

A common outlet valve 93 of one-piece integral construction is carried by the valve plate 31 and may be molded from a suitable material, such as rubber.

Figure 4:
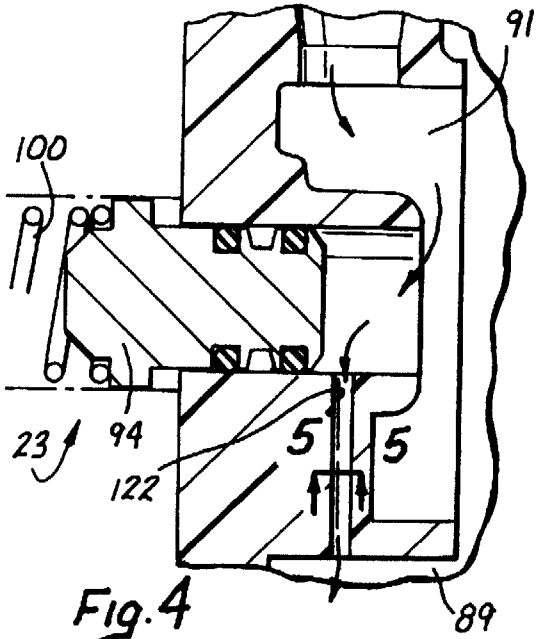
FIG. 4 is a sectional view similar to FIG. 3, with the illustrated bypass valve in the open position.
Figure 3:
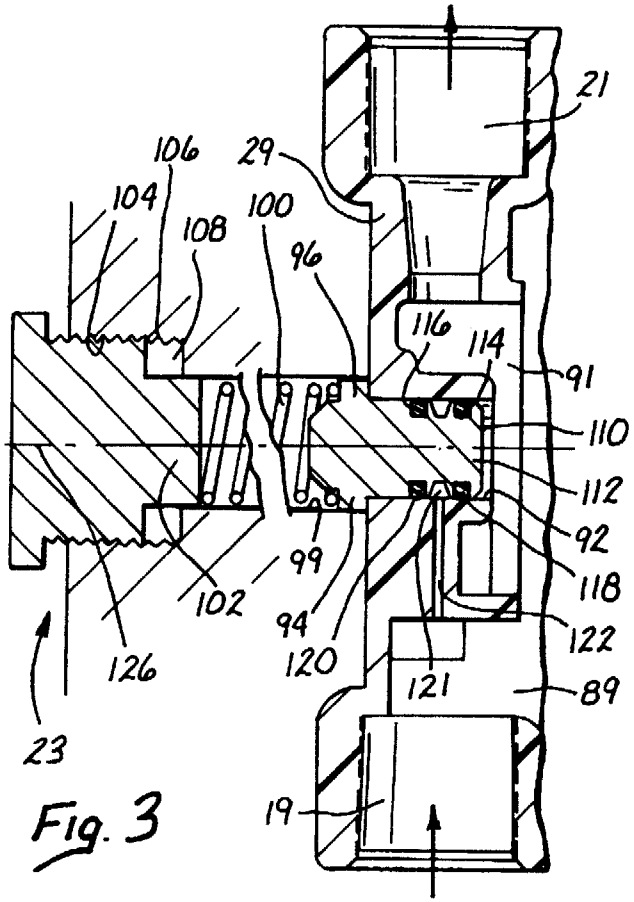
FIG. 3 is a sectional view taken generally along line 3—3 of FIG. 2 with the illustrated bypass valve in the closed position.

As shown in FIG. 3, bypass valve 23 is positioned so that bypass valve element 94 extends into bore 92 in housing section 29. Valve element 94 includes a first end region 96 which is too large to pass into bore 92. End region 96 is located in a larger bore 99 in the housing. Spring 100 is in contact with valve element 94 and with adjustment member 102 which is spaced apart from the valve element. Adjustment member 102 includes an outer peripheral surface 104 which is threaded and is sized to mate with the threads on inner peripheral surface 106 of open housing bore 108. The amount or length of adjustment member 102 threaded into open housing bore 108 can be controlled or adjusted to vary the force of spring 100. The force of spring 100 controls the pressure at which valve element 94 moves from the closed position (FIG. 3) to the open position (FIG. 4).

Valve element 94 includes an end surface 110 which is exposed to the fluid pressure in outlet chamber 91. The forward or second end region 112 of the valve element 94 includes a first notch 114 and a second notch 116, which are spaced apart and circumscribe the valve element. These notches 114 and 116 are sized and adapted to hold first O-ring seal 118 and second O-ring seal 120, respectively. First O-ring seal 118 is sized and adapted to prevent the portion of valve element 94 extending away from surface 110 and beyond the first O-ring seal from being exposed to the fluid pressure from outlet chamber 91 when the bypass valve is in the closed position (FIG. 3). Second O-ring seal 120 is sized and adapted to prevent the portion of the bypass valve element 94 extending away from the outlet chamber and beyond the second O-ring seal from being exposed to the fluid pressure from inlet 19.

Located between first and second notches 114 and 116 is an annulus 121. The annulus 121 completely circumscribes the bypass valve element 94 and acts to distribute the pressure from inlet 19 completely around the bypass valve element and against O-rings 118 and 120. This avoids any side loading on, or preload on, the bypass valve element 94 which could result in unwanted leakage and/or malfunctioning of the bypass valve 23.

Bypass passage 122 extends from the common outlet chamber 91 to the inlet chamber 89.

With bypass valve element 94 in the closed position, as shown in FIG. 3, the fluid in common outlet chamber 91 is prevented from passing through bypass passage 122 into common inlet chamber 89. Thus, the fluid in common outlet chamber passes through outlet 21.

However, when the fluid pressure in common outlet chamber 91 exceeds a certain value, valve element 94 moves against the force of spring 100 to place the bypass valve 23 in the open position. This is shown in FIG. 4. In the open position, fluid from the common outlet chamber 91 passes through bypass passage 122 into common inlet chamber 89. In this manner, the fluid from common outlet chamber 91 is bypassed to the inlet side of the pump. The bypass valve 23 remains in the open position until the pressure on the common outlet chamber 91 is reduced below that which would overcome the force of spring 100 urging the valve element 94 into the closed position.

Figure 5A:
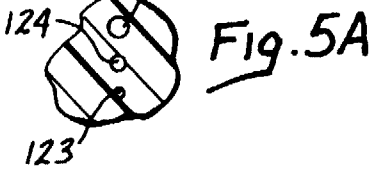
FIG. 5A, 5B 5C and 5D are sectional views of alternate embodiments of bypass passages.
Figure 5C:
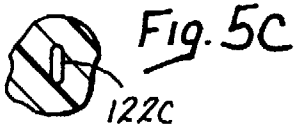
Figure 5B:
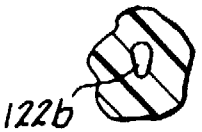
Figure 5D:
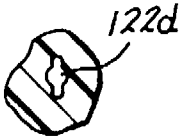
Figure 5:
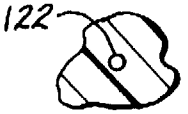
FIG. 5 is a sectional view taken generally along line 5—5 of FIG. 4.

The bypass passage 122 can be of uniform cross-section, such as shown in FIGS. 4 and 5. As shown in FIG. 5, bypass passage 122 can have a circular cross-section.

As shown in FIGS. 5*b*, 5*c* and 5*d*, the bypass passages 122*b*, 122*c* and 122*d*, respectively, can include a non-circular cross-section. The choice of the size and configuration of the bypass passage can be used to control the operation, for example, the opening and closing, of the bypass valve. To illustrate, the configuration of the bypass passage can at least partially control when the bypass valve moves to the open position and fluid flow is established in the bypass passage. After the bypass valve is moved to the open position, the size and configuration of the bypass passage can be used to at least assist in controlling the time period before which the bypass valve again moves to the closed position.

In one useful embodiment, as shown in FIG. 5*a*, the bypass passage includes a plurality of bypass passageways 123, 124 and 125 which are located at different points along the longitudinal axis 126 of the bypass valve. The smallest bypass passageway 123, that is the bypass passageway having the smallest cross-section, preferably is located nearest the common outlet chamber 91, while the largest bypass passageway 125 is located furthest away from the common outlet chamber. This feature is very effective in controlling the movement of the bypass valve 23 so that reduced wear and tear on the bypass valve occurs while effective and controlled fluid bypass is achieved.

Figure 6:
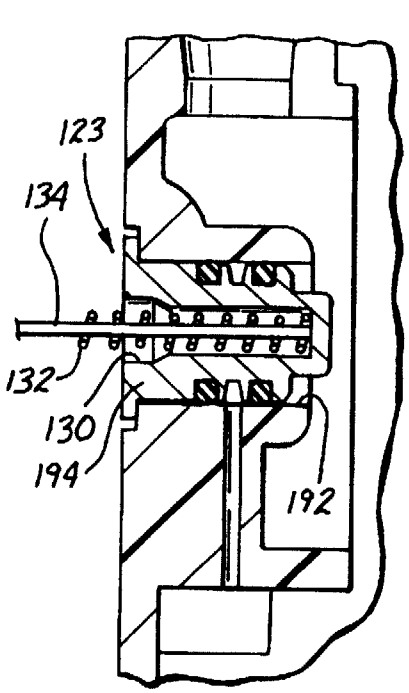
FIG. 6 is a sectional view showing an alternate embodiment of a bypass valve.

FIG. 6 shows an alternate embodiment of the bypass valve in accordance with the present invention. Components of the bypass valve 123 shown in FIG. 6 which correspond to components in the bypass valve shown in FIGS. 3 and 4 have corresponding reference numerals increased by 100.

The primary differences between the bypass valve 123 shown in FIG. 6 and bypass valve 23 shown in FIGS. 3 and 4 are the configuration of the bypass valve element, the shape and positioning of the spring and the use of a rod to stop the movement of the bypass valve element. In particular, the bypass valve element 194 includes a central internal bore 130 in which is located an elongated spring 132. This spring 132 extends away from bypass valve element 194 and comes in contact with the adjustment member (not shown). In addition, an elongated rod 134 is located in internal bore 130 and is sized and adapted so that as bypass valve element 194 moves to place the bypass valve element in the open position, the elongated rod comes in contact with the adjustment member to prevent the bypass valve element from moving completely out of bore 192. This adds an additional safety feature so that the bypass valve 123 continues in operation even after repeated on/off cycles and/or outlet fluid pressure surges.

Although the pump 11 is adapted to pump various fluids, it is particularly adapted for the pumping of water. Activating the motor 13 brings about rotation of the shaft 41, and nutating motion of the wobble plate 49 and the piston sections 59. This nutating motion periodically flexes the regions 61 of the diaphragm 33 to provide a nutating pumping action in each of the pumping chambers 81.

On the intake stroke in each pumping chamber, the pressure reduction in the pumping chamber allows the liquid in the inlet chamber 89 to open the inlet valve 87 as shown in FIG. 2 and flow into the pumping chamber. On the discharge stroke, the pressure in the pumping chamber 81 increases over what it is in the outlet chamber 91 so as to force the associated portion of the resilient section 97 away from the outlet 85. The outlet valve 93 cooperates with the valve plate 31 as described above to seal the other outlets 85 from the outlet 85 which is opened.

When the pressure in the outlet chamber 91 exceeds a certain value, for example, because demand for the pumped liquid in the system downstream of pump 11 has temporarily ceased or stopped, bypass valve 23 (or 123) effectively, reliably and consistently provides for bypass of the liquid from the outlet side to the inlet side of the pump, as described above. Pump 11 remains on and, when there again is demand for the pumped liquid, provides the pumped liquid to the system downstream of the pump.

Although an exemplary embodiment of the invention has been shown and described, many changes, modifications and substitutions may be made by one having ordinary skill in the art without necessarily departing from the spirit and scope of this invention.

What is claimed is:

1. A pump comprising:

a housing having at least a first pumping chamber, an inlet, an inlet passage leading from the inlet to the pumping chamber, an outlet and an outlet passage leading from the pumping chamber to the outlet;

a first pumping member movable in the pumping chamber on an intake stroke whereby fluid from the inlet passage is drawn into the pumping chamber and a discharge stroke whereby fluid in the pumping chamber is discharged into the outlet passage;

a drive for moving the pumping member on the intake and discharge strokes;

a bypass passage leading from a location in the outlet passage to a location in the inlet passage; and a bypass valve being movable in response to the fluid pressure from the outlet passage and substantially independent of the pressure from the inlet passage from a closed position in which fluid is prevented from flowing through the bypass passage to an open position in which fluid flows through the bypass passage.

2. The pump of claim 1 wherein the bypass valve includes a surface exposed to the pressure from the outlet passage in the closed position, a first seal positioned to prevent the surface being exposed to the pressure from the inlet passage in the closed position, and a second seal spaced apart from the first seal and positioned to prevent the portion of the bypass valve extending away from the surface beyond the second seal from being exposed to the pressure from the inlet passage.

3. The pump of claim 2 wherein the bypass valve further includes an annulus located between the first and second seals and being exposed to the pressure from the inlet passage with the bypass valve in the closed position.

4. The pump of claim 1 wherein the bypass valve is structured so that the pressure in the outlet passage at which the bypass valve is movable between the closed position and the open position is adjustable.

5. The pump of claim 1 wherein the bypass valve includes a valve element which is movable to place the bypass valve in the open position and the closed position, and a bias member adapted to act on the valve element and being effective to urge the bypass valve into the closed position.

6. The pump of claim 5 wherein the force of the bias member acting on the valve element is adjustable.

7. The pump of claim 6 which further comprises an adjusting member adapted to be threaded into the housing and to contact the bias member, the force of the bias member acting on the valve element being adjustable in response to the size of the portion of the adjusting member threaded into the housing.

8. The pump of claim 5 wherein the valve element includes an internal bore and the bias member is located at least partly in the internal bore.

9. The pump of claim 6 wherein the bypass valve includes a bore in which the valve element is at least partly located when the bypass valve is in the closed position.

10. The pump of claim 9 which further comprises a stop member adapted to prevent the valve element from moving completely out of the bore when the bypass valve is in the open position.

11. The pump of claim 10 wherein the stop member is located between the valve element and the housing.

12. The pump of claim 1 wherein the bypass passage has a substantially uniform cross-section.

13. The pump of claim 1 wherein the bypass passage has a circular cross-section.

14. The pump of claim 1 wherein the bypass passage has a non-circular cross-section.

15. The pump of claim 1 wherein the bypass passage includes a plurality of spaced apart passageways leading from a location in the outlet passage to a location in the inlet passage, the passageways being located at different points relative to the longitudinal axis of the bypass valve.

16. The pump of claim 15 wherein each of the passageways has a different sized cross-section.

17. The pump of claim 16 wherein the passageways are oriented so that the passageway with the smallest cross-section is located nearest to the outlet passage when the bypass valve is in the closed position and the passageway with the largest cross-section is located furthest from the outlet passage when the bypass valve is in the closed position.

18. The pump of claim 1 which includes only one the bypass valve.

19. The pump of claim 1 wherein the housing includes a plurality of the pumping chambers, the inlet passage leads from the inlet to each of the pumping chambers, the outlet passage leads from each of the pumping chambers to the outlet; and the pump includes a corresponding plurality of the pumping members each of which is movable in one of the pumping chambers on an intake stroke whereby fluid from the intake passage is drawn into the pumping chamber and a discharge stroke whereby fluid in the pumping chamber is discharged into the outlet passage; and the drive is adapted to move each of the pumping members on the intake and discharge strokes.

* * * * *